US010352072B2

(12) United States Patent
Collado et al.

(10) Patent No.: US 10,352,072 B2
(45) Date of Patent: Jul. 16, 2019

(54) SNAP SET DOOR HANDLE AND LOCK KNOB ASSEMBLY

(75) Inventors: Daniel R Collado, Chicago, IL (US); Walter Belchine, III, Joilet, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 93 days.

(21) Appl. No.: 13/703,114

(22) PCT Filed: Aug. 22, 2011

(86) PCT No.: PCT/US2011/048601

§ 371 (c)(1),
(2), (4) Date: Dec. 10, 2012

(87) PCT Pub. No.: WO2012/027265

PCT Pub. Date: Mar. 1, 2012

(65) Prior Publication Data

US 2013/0088022 A1 Apr. 11, 2013

Related U.S. Application Data

(60) Provisional application No. 61/375,922, filed on Aug. 23, 2010.

(51) Int. Cl.
*E05B 85/12* (2014.01)
*E05B 77/38* (2014.01)
(Continued)

(52) U.S. Cl.
CPC ..... *E05B 85/13* (2013.01); *E05B 85/12* (2013.01); *E05B 15/1635* (2013.01);
(Continued)

(58) Field of Classification Search
CPC ..... E05B 85/10; E05B 85/12
(Continued)

(56) References Cited

U.S. PATENT DOCUMENTS 4,580,822 A * 4/1986 Fukumoto ..... 292/336.3
4,858,973 A * 8/1989 Ogasawara et al. ..... 292/347
(Continued)

FOREIGN PATENT DOCUMENTS

EP 0959204 A2 11/1999
EP 1722047 A2 11/2006
(Continued)

OTHER PUBLICATIONS

An International Search Report, dated Dec. 9, 2011, issued in International Application No. PCT/US2011/048601.

*Primary Examiner* — Carlos Lugo
(74) *Attorney, Agent, or Firm* — Pilloff & Passino LLP; Martin J. Cosenza

(57) ABSTRACT

A door handle assembly. The assembly includes a bezel including a depressed base and an integral support bracket. A latch handle is operatively disposed within a first chamber at the bezel interior and a lock knob including a resiliently compressible body is disposed within a second chamber. The lock knob is supported between a pair of opposing bosses. The latch handle is supported between a boss and an opposing wall aperture. The supporting bosses and wall aperture are concentrically oriented with the latch handle and lock knob being supported in rotatable relation about a common axis.

41 Claims, 9 Drawing Sheets

(51) Int. Cl.
*E05B 85/10* (2014.01)
*E05B 15/16* (2006.01)

(52) U.S. Cl.
CPC ..... *E05B 77/38* (2013.01); *E05B 85/10* (2013.01); *Y10T 29/49826* (2015.01); *Y10T 292/57* (2015.04)

(58) Field of Classification Search
USPC ..... 292/336.3
See application file for complete search history.

(56) References Cited

U.S. PATENT DOCUMENTS

| | | | | |
|---|---|---|---|---|
| 5,011,202 | A * | 4/1991 | Kato et al. | 292/336.3 |
| 5,129,694 | A * | 7/1992 | Tanimoto et al. | 292/347 |
| 5,794,994 | A * | 8/1998 | Miyagawa et al. | 292/336.3 |
| 5,895,081 | A | 4/1999 | Tanimoto et al. | |
| 6,167,779 | B1 | 1/2001 | Sano et al. | |
| 6,976,717 | B2 * | 12/2005 | Barr et al. | 292/336.3 |
| 6,988,752 | B2 * | 1/2006 | Belchine et al. | 292/336.3 |
| 7,520,543 | B2 | 4/2009 | Purdy et al. | |
| 7,527,307 | B2 | 5/2009 | Belchine, III et al. | |
| 8,408,611 | B2 * | 4/2013 | Takagai et al. | 292/336.3 |
| 8,727,401 | B2 * | 5/2014 | Tanaka et al. | 292/336.3 |
| 2004/0212200 | A1 | 10/2004 | Kakita | |
| 2005/0134058 | A1 | 6/2005 | Belchine, III et al. | |

FOREIGN PATENT DOCUMENTS

| | | | |
|---|---|---|---|
| JP | H09235917 | A | 9/1997 |
| JP | 2004-324294 | A | 11/2004 |
| JP | 2005307533 | A | 11/2005 |

* cited by examiner

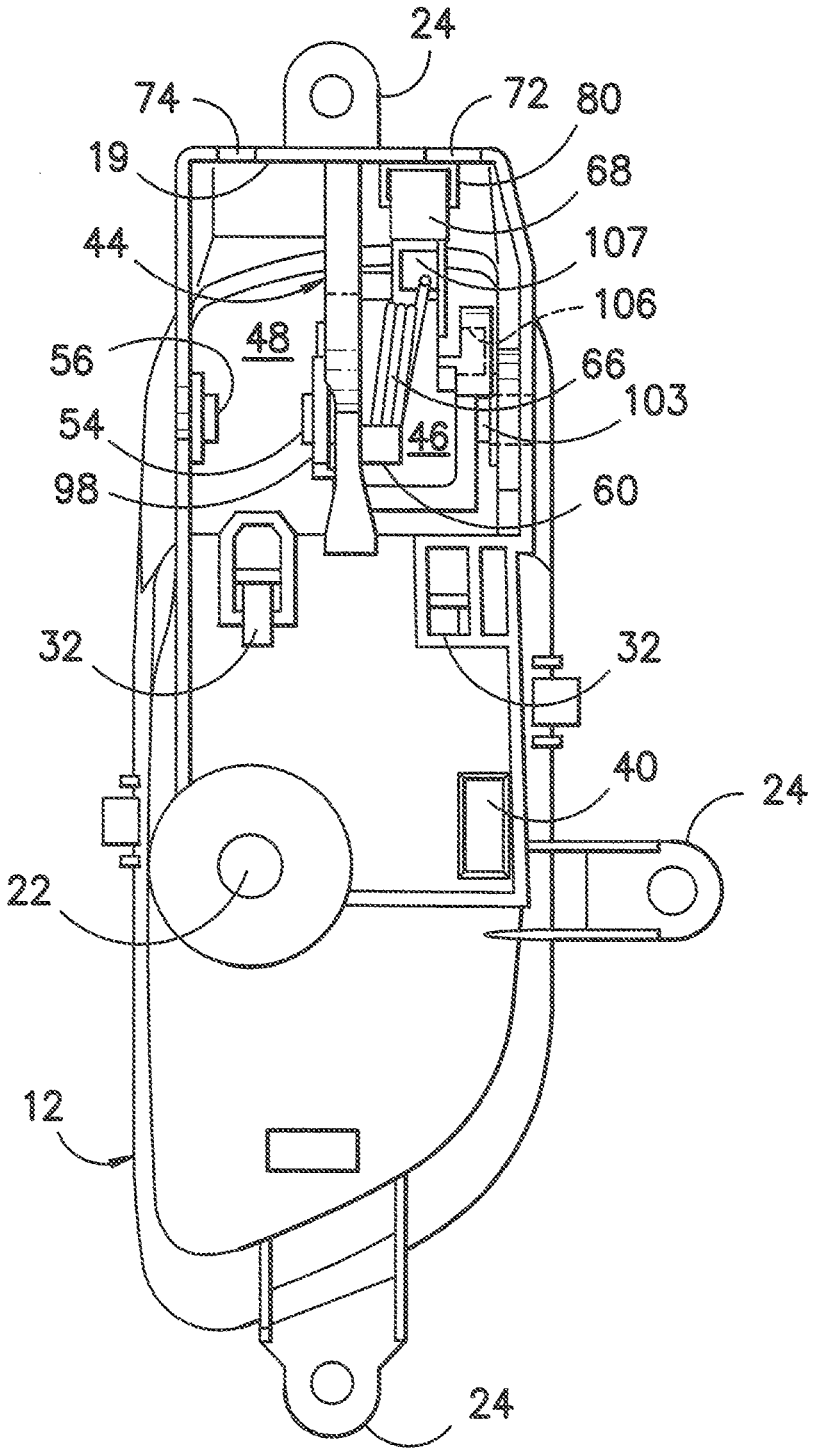
FIG. —7—

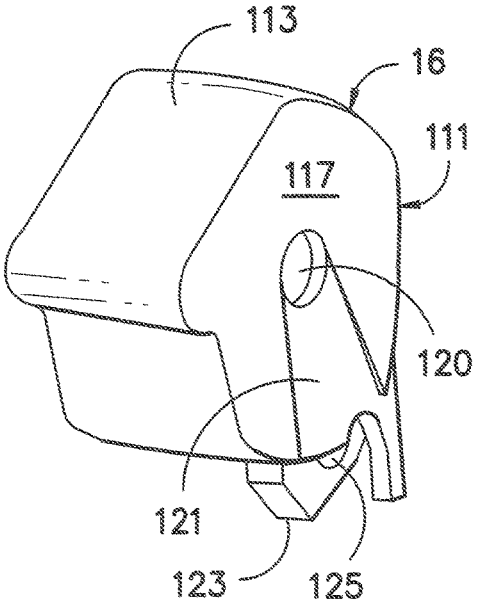
FIG. —8—
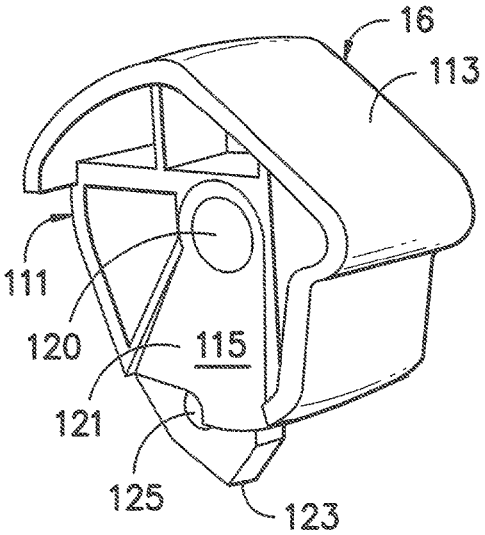
FIG. —9—
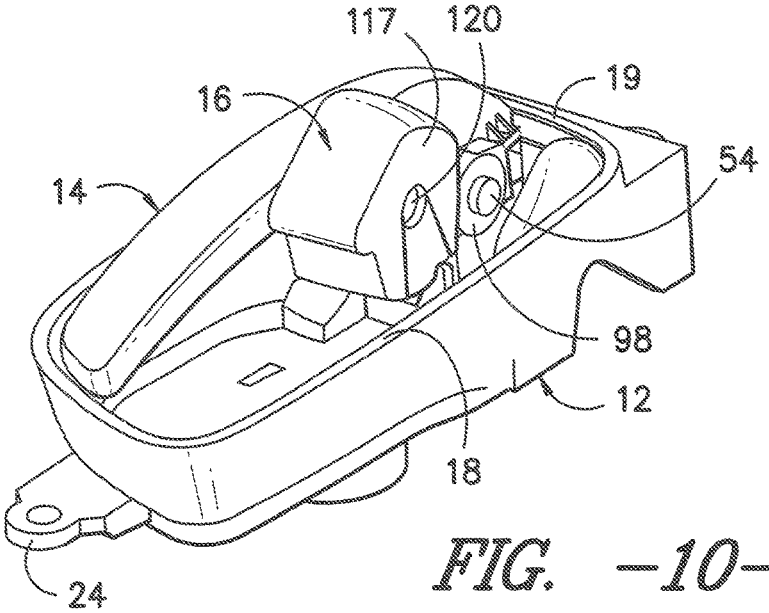
FIG. —10—

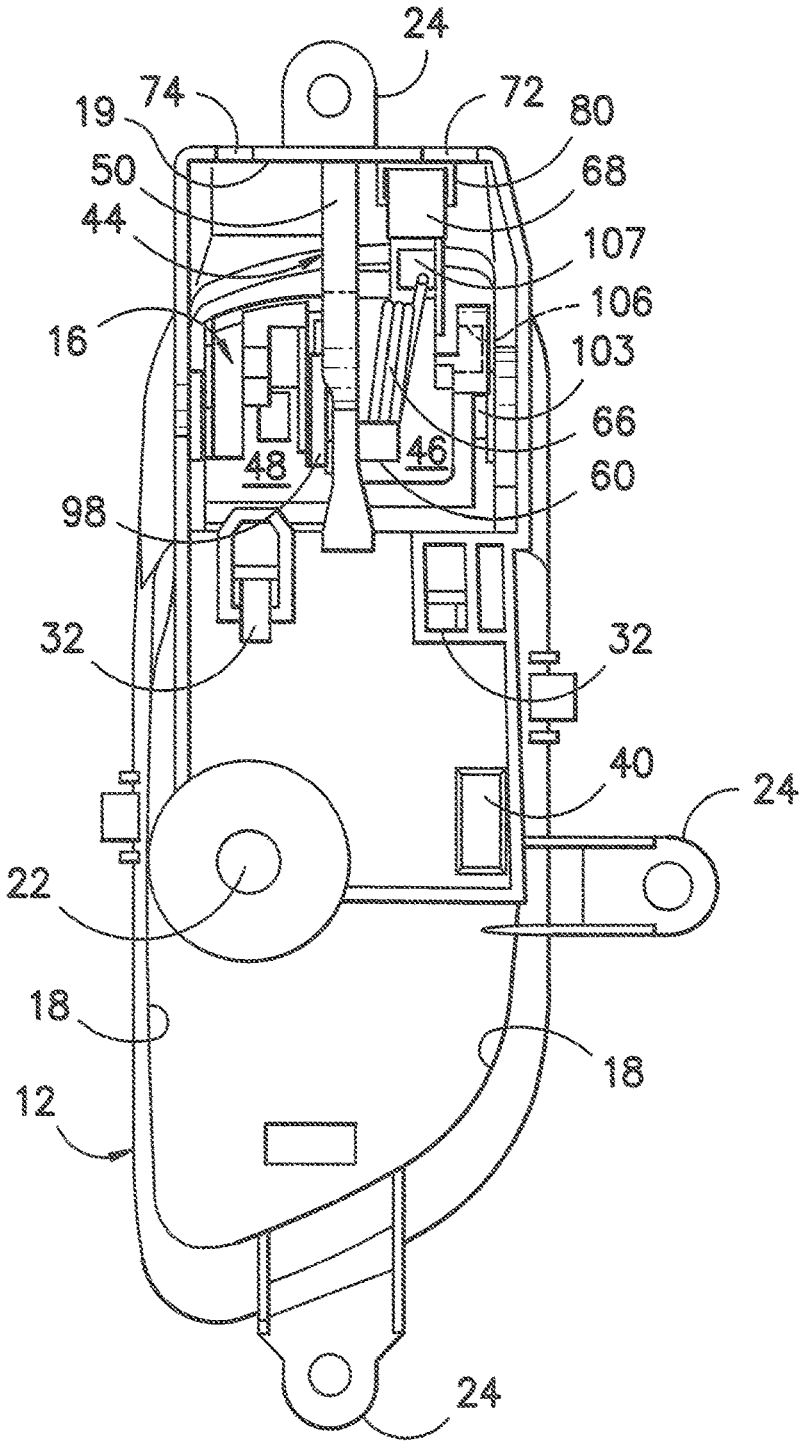
FIG. —11—

SNAP SET DOOR HANDLE AND LOCK KNOB ASSEMBLY

CROSS REFERENCE TO RELATED APPLICATIONS

This application is a National Stage of PCT/US2011/048601 filed Aug. 22, 2011 and claims the benefit of and priority from U.S. provisional application 61/375,922 filed Aug. 23, 2010.

TECHNICAL FIELD

The present invention relates generally to automobile door handle assemblies, and, more particularly, the invention relates to a compact door handle assembly incorporating a door latch release handle and lock knob mounted in coaxial relation.

BACKGROUND

Vehicle door handle assemblies are known to include a door latch release handle connected by a cable to the door latch mechanism that is triggered to release the door by operation of the handle. Vehicle doors also are known to include a lock mechanism to secure the door in a closed condition. Manually operated lock mechanisms typically include an activator knob or button for engaging and disengaging the lock mechanism.

Manually activated door handle mechanisms have taken a variety of different constructions. It is known to use designs in which both the latch handle and lock knob are inset in the door panel, often contained in a single housing or located adjacent each other in a portion of the door. Cables from each of the latch handle and the lock knob interconnect the handle and knob to the respective mechanisms for releasing the door and for locking and unlocking the door. Moving the latch handle actuates the latch mechanism to unlatch the door. The latch handle returns to the non-actuating position when it is released. Lock mechanisms are known to operate with a lock knob that toggles between locked and unlocked positions.

It is known to use a pin or pins through the latch handle and lock knob to secure the handle and knob in the housing. The handle and knob each can be rotated about the pin during operation and use of the mechanisms. The pin or pins are inserted through apertures in the housing and handles and must be secured therein. The use of a fastener or retainer such as a compression cap on the pin ends effectively retains the pin in position but renders the assembly of the mechanism both complicated and time consuming.

U.S. Pat. No. 6,988,756 provides an assembly in which a handle and lock knob are supported in coaxial rotating relation on an unseen base. A separate show surface bezel is attached for styling purposes to complete the assembly. While such a construction is highly functional, the assembly process may require a relatively high level of skill and requires a fairly large number of components due to the need for the separate show-surface bezel.

SUMMARY

The present invention provides advantages and alternatives over the prior art by providing a handle assembly of a transportation vehicle. The design allows for reduction in the number of components without sacrificing function which is a cost savings not only in components but in assembly and tooling. The present invention uses a common axis for the handle and the lock knob. Such concentricity permits cohesive rotation of the lock knob and the knob. Also, the present invention may use standard circular bosses that are not restrictive for assembly thus providing a simplified automation. In addition, the present invention allows for the elimination of a secondary base component because the base can now be combined into the show surface bezel without risk of damage during assembly.

In one aspect thereof, the present invention provides a door handle assembly. The assembly includes a bezel including a depressed base extending partially but not completely along the length of the bezel, a first lateral sidewall and a second lateral sidewall extending upwardly from the base, an end wall disposed in space-apart forward relation from a forward edge of the base, and an integral support bracket extending between the base and the end wall to define a boundary between a first chamber and a second chamber in the space between the base and the end wall. The support bracket includes a first mounting boss projecting away from one side of the support bracket. The first lateral sidewall includes a boss-receiving wall aperture therein. The second lateral sidewall includes a second mounting boss projecting in opposing aligned relation to the first mounting boss such that the first mounting boss, the second mounting boss and the wall aperture are substantially concentrically aligned along a common axis. The assembly further includes a latch handle including an ear disposed within the first chamber and a boss-receiving flange disposed in spaced-apart relation from the ear. The ear includes a laterally projecting handle boss. A portion of the support bracket is disposed in nested relation between the ear and the boss-receiving flange with the handle boss extending into the boss-receiving wall aperture and the first mounting boss projecting through the boss-receiving flange such that a distal portion of the first mounting boss projects outwardly from the boss-receiving flange towards the second mounting boss. The assembly further includes a lock knob including a resiliently compressible body disposed within the second chamber. The lock knob has a first lateral face and a second lateral face. The first lateral face and the second lateral face each include an aperture such that upon press-fit insertion of the body into the second chamber, the distal portion of the first mounting boss projects into the aperture in the first lateral face and the second mounting boss projects into the aperture in the second lateral face and the lock knob is supported in rotatable relation about the common axis with the latch handle.

In another aspect thereof, the present invention provides a method of assembling a vehicle door handle assembly. The method includes providing a bezel including a depressed base extending partially but not completely along the length of the bezel, a first lateral sidewall and a second lateral sidewall, an end wall disposed in space-apart forward relation from a forward edge of the base, and an integral support bracket extending between the base and the end wall to define a boundary between a first chamber and a second chamber in the space between the base and the end wall. The support bracket includes a first mounting boss projecting away from one side of the support bracket. The first lateral sidewall includes a boss-receiving wall aperture therein. The second lateral sidewall includes a second mounting boss projecting in opposing aligned relation to the first mounting boss such that the first mounting boss, the second mounting boss and the wall aperture are substantially concentrically aligned along a common axis. The method further includes providing a latch handle including an ear and a boss-receiving flange disposed in spaced-apart relation from the ear. The ear includes a laterally projecting handle boss. The latch handle is arranged with the support bracket disposed in nested relation between the ear and the boss-receiving flange with the handle boss extending into the boss-receiving wall aperture and the first mounting boss projecting through the boss-receiving flange such that a distal portion of the first mounting boss projects outwardly from the boss-receiving flange towards the second mounting boss. The method further includes providing a lock knob including a resiliently compressible body having a first lateral face and a second lateral face. The first lateral face and the second lateral face each include an aperture. The body undergoes press-fit insertion between the support bracket and second lateral sidewall such that the distal portion of the first mounting boss projects into the aperture in the first lateral face and the second mounting boss projects into the aperture in the second lateral face and the lock knob is supported in rotatable relation about the common axis with the latch handle.

Other features and advantages of the invention will become apparent to those of skill in the art upon review of the following detailed description, claims and drawings.

BRIEF DESCRIPTION OF THE DRAWINGS

FIG. 7 is a partial assembly bottom plan view of the bezel portion following introduction of the latch handle, biasing spring and bumper into a first chamber;

FIGS. 8 and 9 are opposing perspective side views of an exemplary lock knob adapted for press-in insertion into a second chamber within the bezel;

FIG. 10 is a partial assembly view illustrating orientation of the lock knob;

FIG. 11 is a bottom plan view of the bezel portion following introduction of the lock knob into the second chamber.

Figure 1:
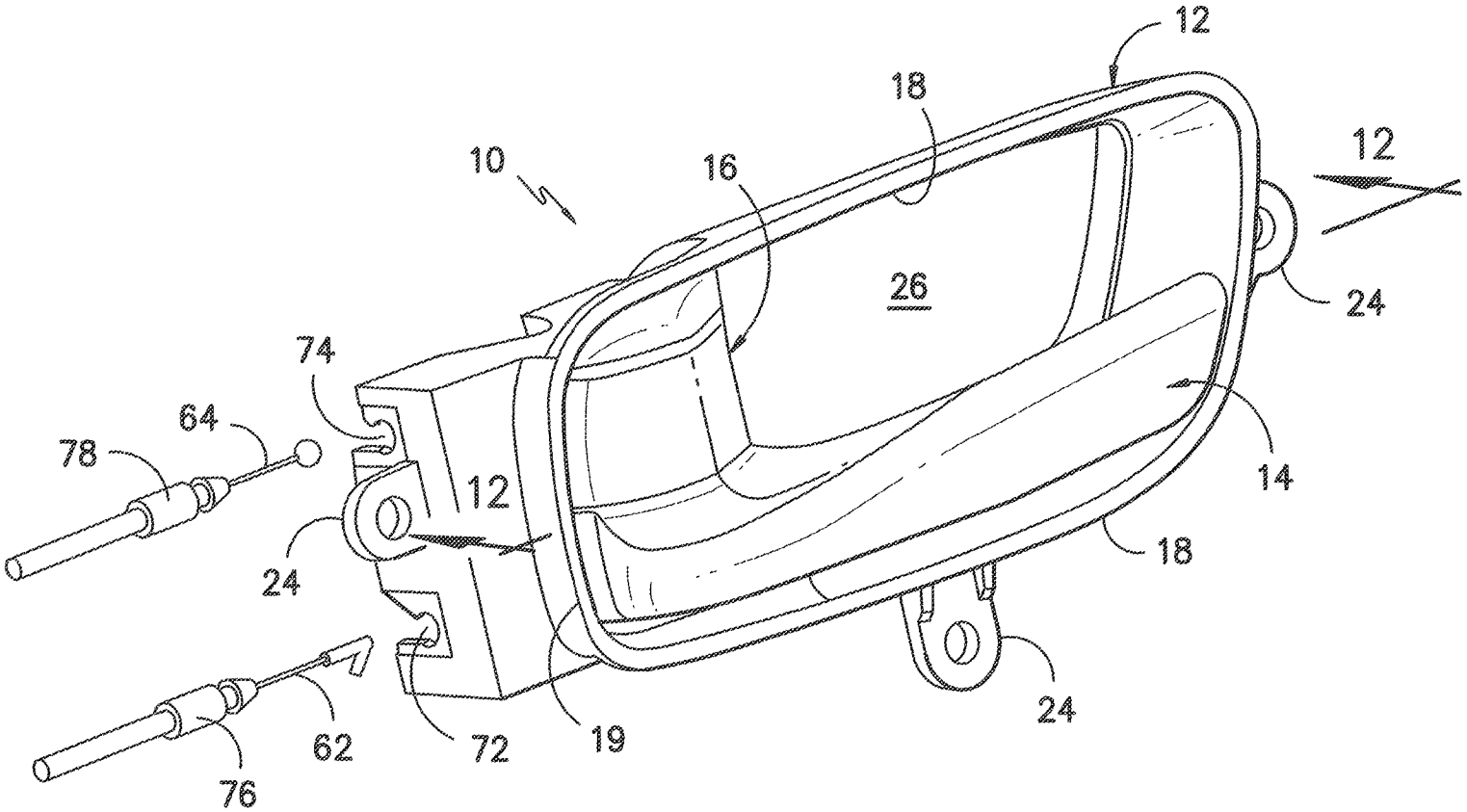
FIG. 1 is an elevation perspective view of an exemplary door handle assembly in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF PREFERRED EMBODIMENTS

Reference will now be made to the drawings wherein to the extent possible like reference numerals are used to designate like elements in the various views. Referring to FIG. 1, an exemplary door handle assembly 10 is shown. In the illustrated exemplary construction the door handle assembly 10 includes a bezel 12 adapted for installation and attachment in a vehicle door panel, armrest or the like. A latch handle 14 and lock knob 16 are operatively mounted within the bezel 12.

Figure 2:
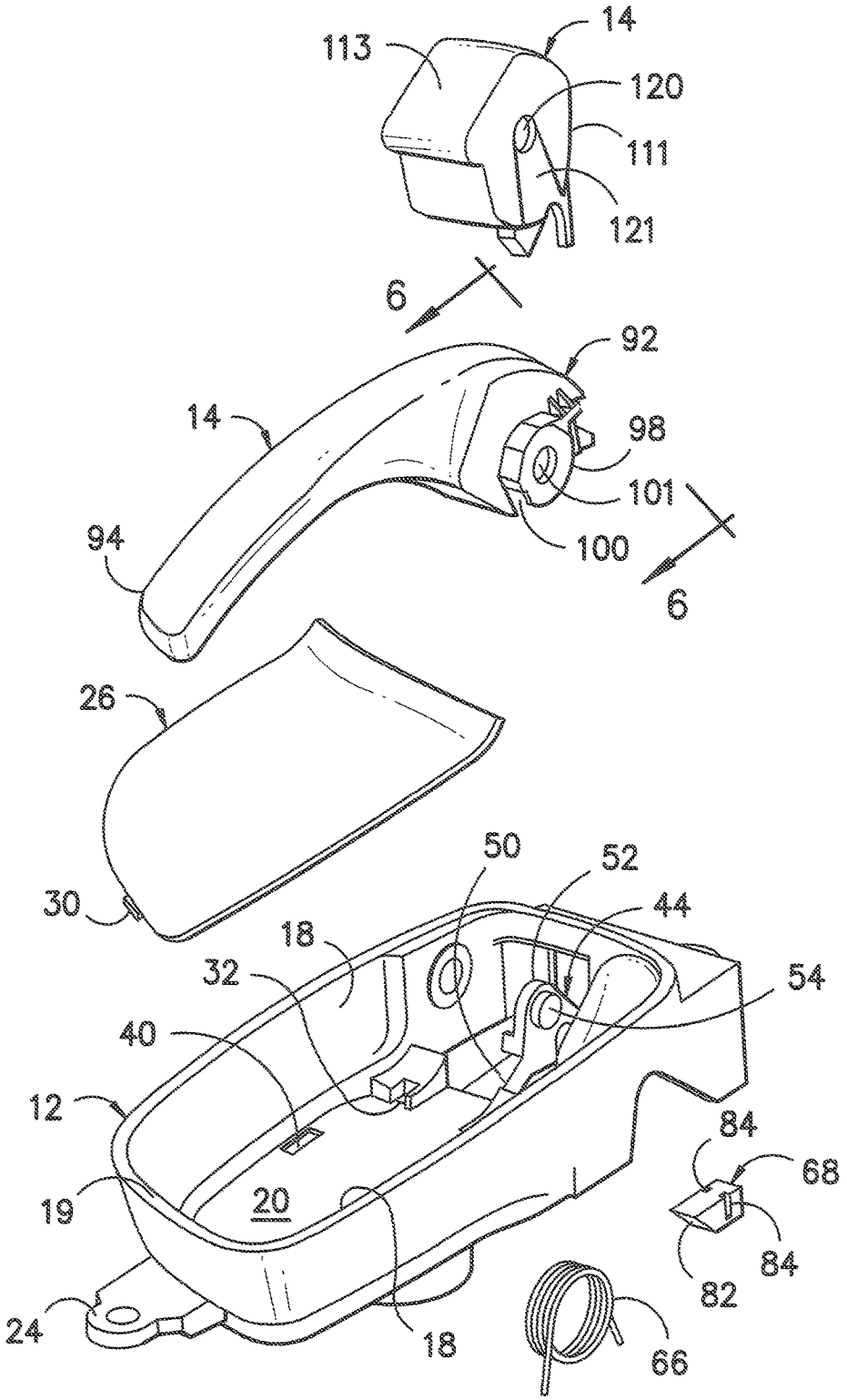
FIG. 2 is a schematic exploded view of the exemplary door handle assembly.

The bezel 12, latch handle 14 and lock knob 16 each may be formed as a unitary structure from suitable plastic materials using techniques such a injection molding or the like. As shown, the bezel has a concave construction with an arrangement of upstanding lateral sidewalls 18 and a forward end wall 19 disposed around a base 20 of depressed profile (FIG. 2). According to the potentially preferred practice, the interior surfaces of the sidewalls define show surfaces for the final door handle assembly which require no further treatment. In the illustrated construction, the base 20 may include one or more optional interior mounting apertures 22 (FIG. 3) at the interior for receipt of connection elements such as screws or the like to connect the door handle assembly 10 to the underlying support structure. In this regard, an arrangement of outboard mounting flanges 24 also may be provided for receipt of mounting screws or other connection elements. As will be appreciated, the number and arrangement of the mounting flanges 24 may be set to facilitate connection to the surrounding support surface.

As shown, in the event that one or more interior mounting apertures 22 are present within the base 20, an interior cover 26 may be provide for snap-in connection in juxtaposed relation across the surface of the base 20. According to one exemplary practice, the interior cover 26 may include a plurality of downwardly projecting feet of generally "L" shaped construction (not shown) at one end and a downwarly projecting snap tab 30 at an opposing end. In this regard, in the illustrated construction the feet may be pressed into corresponding aligned acceptance slots 32 with the snap tab 30 being pressed into a corresponding tab opening 34. A chamfered surface of the snap tab 30 and the distal portions of the feet project in generally opposite directions. If desired, the interior cover 26 may also include one or more alignment tabs along a lateral edge to engage corresponding grooves 40 at the base 20 to facilitate proper placement and to provide support for the interior cover upon final installation. As will be appreciated, upon installation of the interior cover 26, the snap tab 30 and the distal portions of the feet 28 held in hooking relation beneath the interior cover 26. Of course, it is likewise contemplated that the interior cover 26 may be eliminated if desired.

Figure 3:
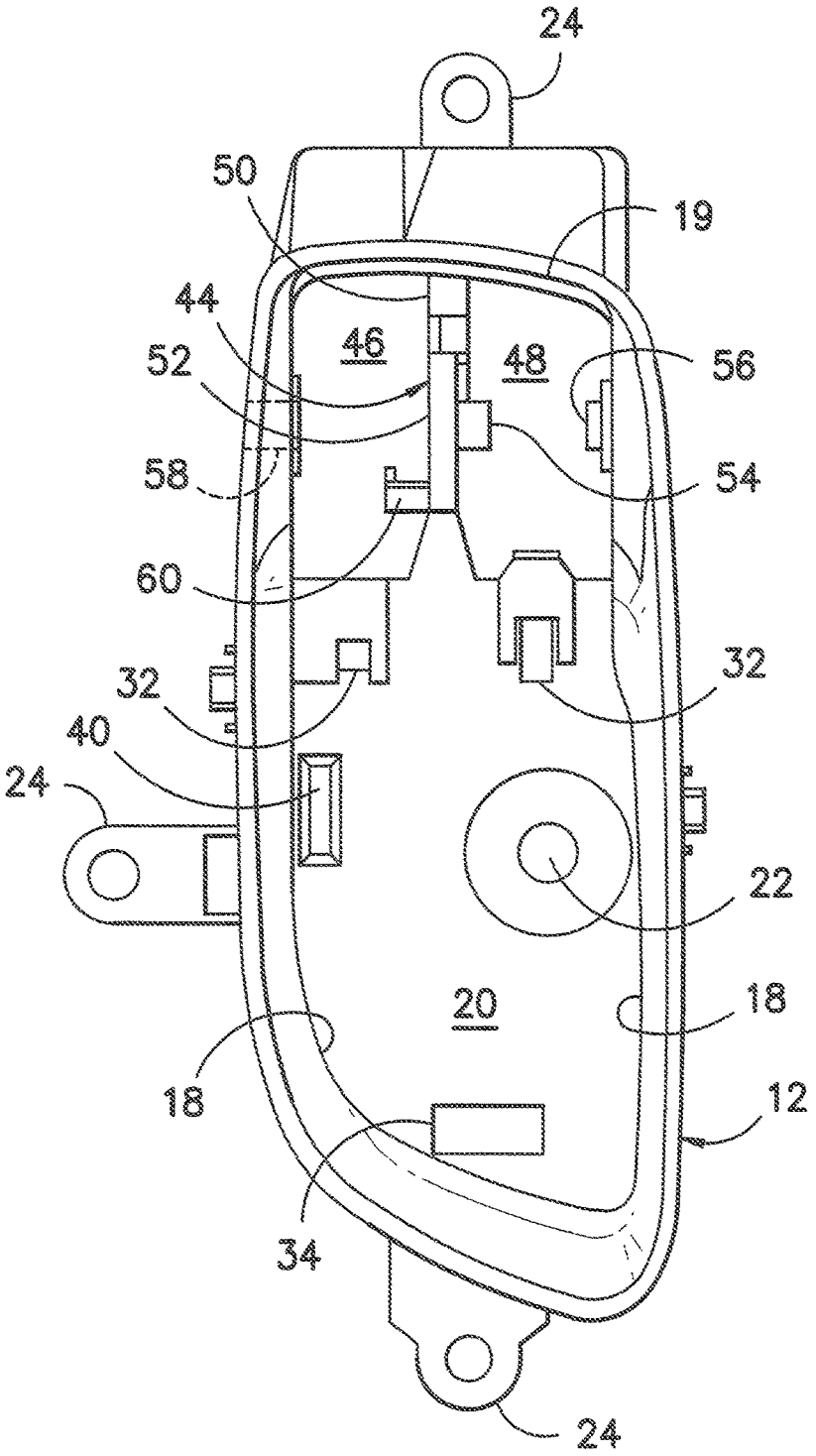
FIG. 3 is a top plan view of an empty bezel portion of the exemplary door handle assembly of FIG. 1.
Figure 4:
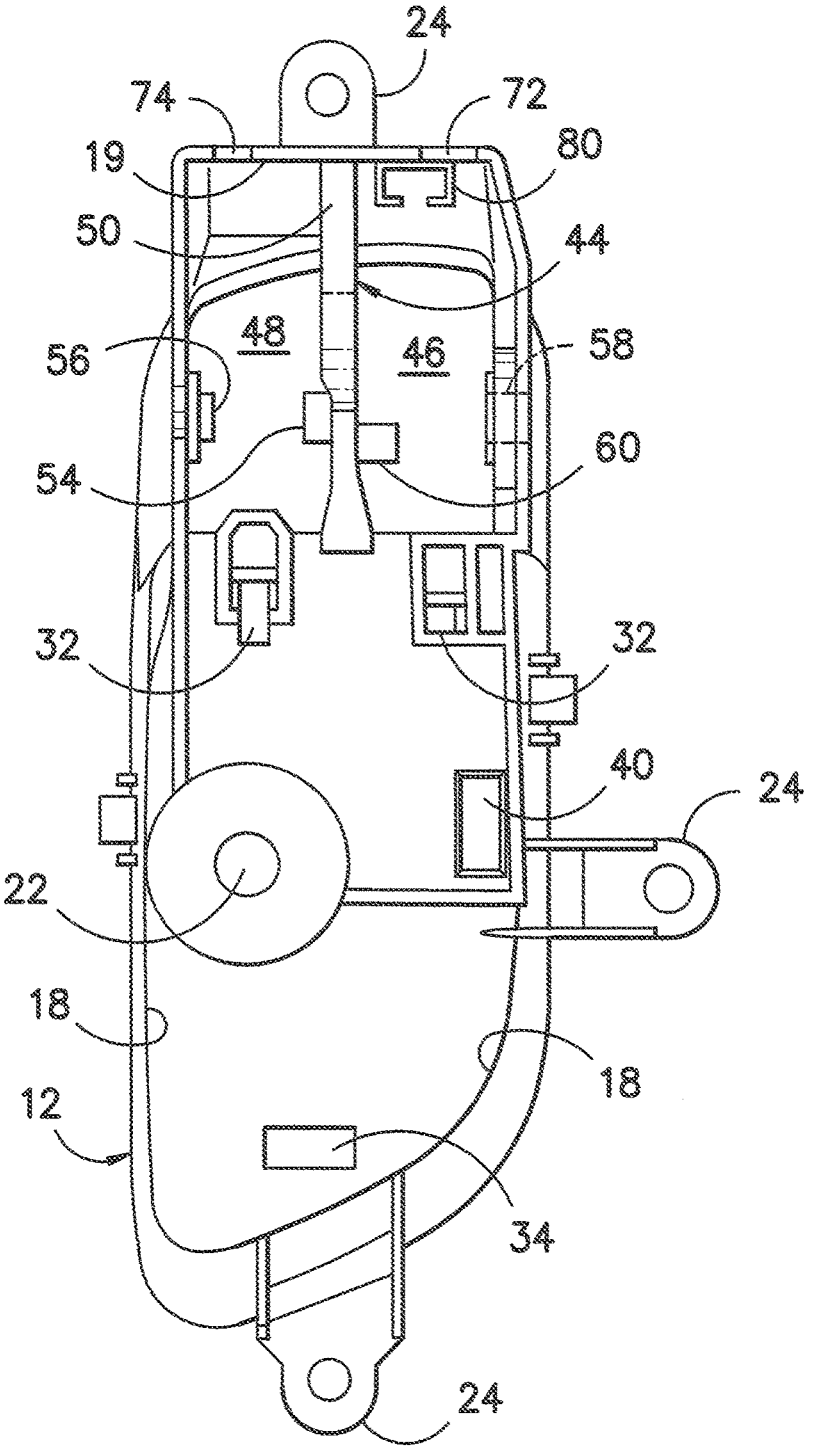
FIG. 4 is a bottom plan view of the empty bezel portion shown in FIG. 3.

In the illustrated exemplary configuration, the bezel 12 has a generally open bottom at the position forward of the base 20. The open bottom is split by a raised support bracket 44 extending generally between a forward edge of the base 20 and end wall 19. As best seen in FIGS. 3 and 4, the support bracket 44 divides the bottom into a first chamber 46 for receipt of a portion of the latch handle 14 and a second chamber 48 for receipt of the lock knob 16. As shown, in the exemplary construction the support bracket 44 includes a longitudinal support rib 50 with a flange 52 extending upwardly from the support rib 50. In the illustrated construction, the flange 52 includes a first boss 54 of generally circular configuration projecting from the flange 52 and partially across the second chamber 48. As shown, the first boss 54 is disposed in spaced-apart, concentrically aligned relation to a second boss 56 of generally circular configuration projecting from the opposing sidewall. The first boss 54 and the second boss 56 are also aligned substantially concentrically with a wall aperture 58 of generally circular configuration in the sidewall bordering the first chamber 46. The first boss 54, second boss 56 and wall aperture 58 are used to cooperatively support components of the door handle assembly 10 in rotatable, coaxial relation in a manner to be described further hereinafter. While the bosses 54, 56 and the wall aperture 58 are preferably circular, it is likewise contemplated that polygonal or other constructions also may be used if desired.

As shown, the support bracket 44 also includes an integral open sided cradle flange 60 with a generally "L" shaped cross section which projects away from the support bracket 44 and partially into the first chamber 46. In the exemplary construction the cradle flange 60 has an open side facing away from the forward edge of the base 20 and towards end wall 19. In operation, the cradle flange 60 supports one end of a biasing spring 66 providing a return force for the latch handle 14 during operation. The biasing spring may be positioned by a simple linear pressing action from the bottom of the bezel.

A latch cable 62 (FIG. 1) is operatively connected to latch handle 14 at one end, and at the opposite end to a latch/release mechanism (not shown) of the vehicle door. A lock cable 64 is operatively connected at one end to the lock knob 16 and at an opposite end to a lock mechanism (not shown) of the vehicle door. End wall 19 defines a first cable slot 72 for the latch cable 62 and a second cable slot 74 for the lock cable 64. Grommet-like sleeve fittings 76, 78 (FIG. 1) are provided on the cables 62, 64, respectively, by which such fittings are secured in the cable slots 72, 74 with the cables 62, 64 being slideable within the fittings during operative manipulation by the latch handle 14 and lock knob 16.

As best seen in FIG. 4, in the illustrated exemplary construction the interior of the end wall 19 also defines an integrally molded "C" bracket 80 projecting inwardly into the first chamber 46 for retention of a resilient bumper 68. As shown in FIG. 2, in the exemplary construction the bumper 68 has generally trapezoidal configuration with parallel upper and lower surfaces with the lower surface being shorter than the upper surface. An angled contact face 82 defining a resting surface for the latch handle 14 is oriented in downwardly angled relation from the edge of the upper surface to the edge of the lower surface. A pair of lateral guide slots 84 extends downwardly from the upper surface to a position above the lower surface. During assembly, the resilient bumper 68 may be pressed onto the "C" bracket 80 from below using a linear motion such that the distal wall segments of the "C" bracket 80 slide into the guide slots 84 thereby clamping the resilient bumper in place at the interior of the end wall 70 and with the contact face projecting into the first chamber. Of course, other bumper configurations may likewise be used if desired.

In the illustrated exemplary construction, the latch handle 14 is a substantially monolithic structure of molded plastic or the like, and includes an anchor end 92 and a distal end 94. The anchor end 92 has a split wall construction with a contoured ear 96 set in spaced-apart relation from a boss receiving flange 98 to define a handle cavity 100. As best seen in FIG. 2, the anchor end 92 forms a generally right angle with hand grasp such that the contoured ear 96 extends down into the first chamber 46 with hand grasp extending away from the first chamber and the end wall 19.

At the anchor end 92, the boss receiving flange 98 defines a lateral acceptance opening 101 which is adapted receive the first boss 54 by linear manipulation of the latch handle 14 during assembly. More specifically, according to a contemplated practice illustrated in FIG. 5, the latch handle 14 is moved sequentially down such that the flange 52 and first boss 54 enter the handle cavity 100. The latch handle 14 is then moved laterally such that the first boss 54 projects through the acceptance opening 101. As shown, the exterior of the contoured ear 96 includes a handle boss 103 which is disposed in substantial alignment with the acceptance opening 101. As the latch handle 14 is moved laterally to capture the first boss 54 within the boss receiving flange 98, the outwardly projecting handle boss 103 is caused to enter the wall aperture 58. An axis of rotation for the latch handle 14 is thereby established through the first boss 54 supported within the boss receiving flange 98 and the handle boss 103 supported within the wall aperture 58. At a lower end, the contoured ear 96 also includes a well 106 for receiving and retaining a latch cable anchor in the form of a ball, cylinder or the like disposed at a terminal end of the latch cable 62 such that movement of the latch handle 14 is translated to the latch cable 62.

In the exemplary construction, the anchor end 92 of the latch handle 14 also includes a distal projecting foot 107 disposed between the contoured ear 96 and the boss receiving flange 98. In the exemplary construction, the distal projecting foot 107 is oriented to be in lateral offset relation to the cradle flange 60 at a distance generally corresponding to the height of the biasing spring 66. Upon installation, one leg of the biasing spring 66 is held in compression against the distal projecting foot 107, while the other leg of the biasing spring 66 is held in compression within the cradle flange 60. Thus, upon rotation of the latch handle, the biasing spring 66 undergoes further compression while continuously urging the latch handle 14 back to the initial condition shown in FIG. 1.

In the exemplary construction, the lock knob 16 is a single-piece structure of molded plastic or the like, configured to be received in the second chamber 48. The lock knob 16 has a split body 111 extending away from an outer user engagement surface 113. The lock knob 16 includes an interior lateral face 115 and an exterior lateral face 117 separated by a crevice or gap such that the lateral faces 115, 117 are susceptible to slight compression towards one another. Each of the lateral faces includes a boss-receiving opening 120 substantially aligned with one another. Each of the lateral faces may further include a reduced profile lead-in segment 121 having a flared angle configuration extending away from the boss-receiving opening 120 to the perimeter of the corresponding lateral face.

The illustrated exemplary lock knob 16 also includes a connector portion 123 extending into the second chamber 48. The connector portion 123 includes an opening 125 for threading the lock cable 64 such that rotational movement of the lock knob 16 translates to the lock cable 64. During assembly, the lock knob 16 may be installed by a linear press-in motion following installation of the latch handle 14 in the manner described previously. In this regard, as the lock knob 16 is pressed into place, the boss-receiving opening at the interior lateral face 115 is caused to receive and retain the distal portion of the first boss 54 projecting through the boss-receiving flange 98. Concurrently, the boss-receiving opening at the exterior lateral face 117 is caused to receive and retain the second boss 56. The first boss 54 and the second boss 56 are guided into the boss receiving openings in the lateral faces 115, 117 by the reduced profile lead-in segments 121. During the installation process the bosses 54, 56 compress the lateral faces 115, 117 towards one another to narrow the gap in the split body. Once the bosses 54, 56 enter the corresponding openings, the compression against the lateral faces 115, 117 is relieved and they spring away from one another thereby securing the lock knob 116 in place.

In the final construction both the latch handle 14 and the lock knob 16 are rotatable through angles about a common axis running through the first boss 54, the second boss 56 and the wall aperture 58. Moreover, the lock knob 16 is held between two opposing bosses. Following complete installation, the latch handle 14 and lock knob 16 can pivot smoothly about a common axis within the bezel 12.

Figure 5:
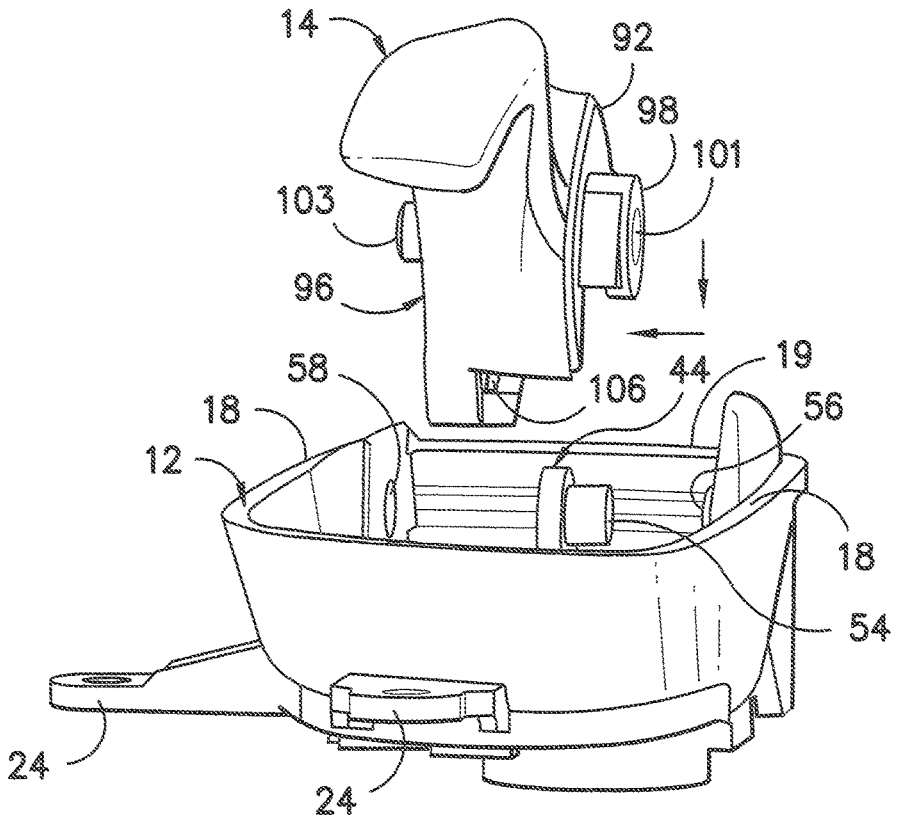
FIG. 5 is a partial assembly view illustrating placement of a latch handle within a bezel during construction of an exemplary door handle assembly.
Figure 6:
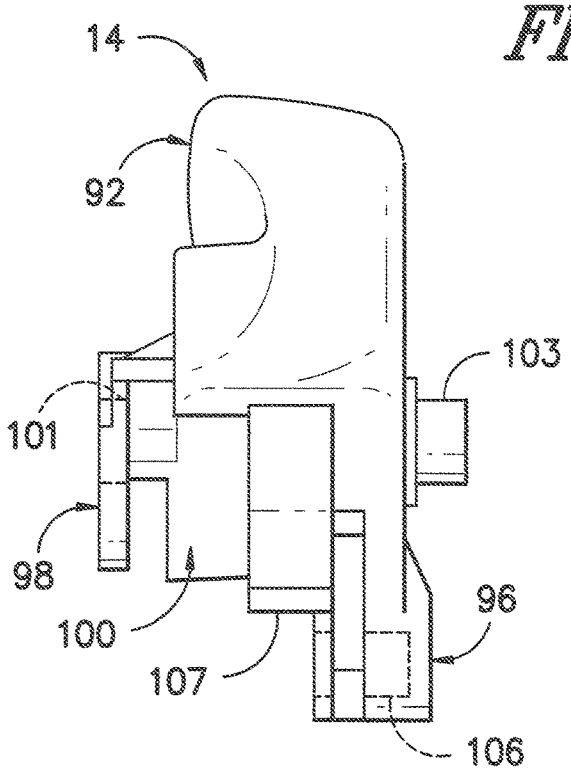
FIG. 6 is an end view of an exemplary latch handle taken generally along line 6-6 in FIG. 2 illustrating the seating structure for the handle.
Figure 12:
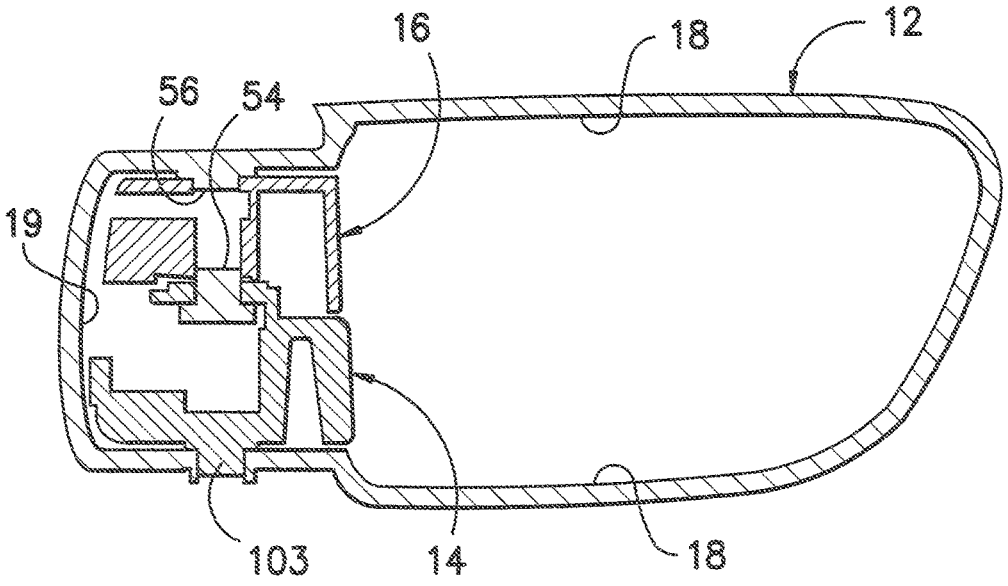
FIG. 12 is a schematic view taken generally along line 12-12 in FIG. 1 illustrating the coaxial mounting arrangement of the latch handle and lock knob within the bezel.

As will be appreciated, the exemplary assembly may be constructed entirely using a series of simple linear motions without the need for any twisting manipulation of components. Specifically, the latch handle 14 may be positioned by a sequence of downward and lateral movements as shown in FIG. 5. The biasing spring 66 and the bumper 68 may likewise be positioned by simple linear pressing motions and the lock knob 16 is installed by a simple linear pressing motion. Such linear motion assembly may substantially reduce complexity thereby promoting operational efficiency and reducing the potential for error.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art. Various features of the invention are set forth in the following claims.

What is claimed is:

1. A door handle assembly comprising:

a bezel including a depressed base extending partially but not completely along the length of the bezel, a first lateral sidewall and a second lateral sidewall, an end wall disposed in space-apart forward relation from a forward edge of the base, and an integral support bracket extending between the base and the end wall to define a boundary between a first chamber and a second chamber in the space between the base and the end wall, the support bracket including a first mounting boss projecting away from one side of the support bracket, the first lateral sidewall including a boss-receiving wall aperture therein, the second lateral sidewall including a second mounting boss projecting in opposing aligned relation to the first mounting boss such that the first mounting boss, the second mounting boss and the wall aperture are substantially concentrically aligned along a common axis;

a latch handle including an ear disposed within the first chamber and a boss-receiving flange disposed in spaced-apart relation from the ear, the ear including a laterally projecting handle boss, wherein a portion of the support bracket is disposed in nested relation between the ear and the boss-receiving flange with the handle boss extending into the boss-receiving wall aperture and the first mounting boss projecting through the boss-receiving flange such that a distal portion of the first mounting boss projects outwardly from the boss-receiving flange towards the second mounting boss; and a lock knob including a resiliently compressible body disposed within the second chamber, the lock knob including a first lateral face and a second lateral face, the first lateral face and the second lateral face each including an aligned aperture such that upon press-fit insertion of the body into the second chamber, the distal portion of the first mounting boss projects into the aperture in the first lateral face and the second mounting boss projects into the aperture in the second lateral face such that the lock knob is supported in rotatable relation about the common axis with the latch handle, wherein the bezel establishes an open interior compartment enveloping at least a substantial portion of the latch handle and at least a substantial portion of the lock knob, and wherein a bumper bracket is positioned near the bottom of the first chamber to project away from the end wall and into the first chamber with a resilient bumper mounted within the bumper bracket from below the bezel.

2. The door handle assembly of claim 1, wherein the bezel is of monolithic, polymer molded construction.

3. The door handle assembly of claim 2, wherein the depressed base extends over a majority of a longitudinal distance of the interior of the bezel, and the depressed base extends completely across a lateral distance of the interior of the bezel.

4. The door handle assembly of claim 1, wherein the lock knob is of monolithic, polymer molded construction.

5. The door handle assembly of claim 1, wherein each of the bezel, the latch handle and the lock knob is of monolithic, polymer molded construction.

6. The door handle assembly of claim 1, further including an interior cover disposed in juxtaposed snap-in relation across the base, and wherein the interior cover in combination with interior portions of the first and second lateral sidewalls cooperatively define a visible show surface for the door handle assembly.

7. The door handle assembly of claim 1, wherein the lock knob body is of split construction with a gap between the first lateral face and the second lateral face.

8. The door handle assembly of claim 1, wherein an integral open sided cradle flange extends away from the support bracket and into first chamber and wherein one leg of a biasing spring is supported at the open sided cradle and an opposing leg of the biasing spring operatively engages a surface of latch handle within the first chamber such that rotation of the latch handle causes compression of the biasing spring.

9. The door handle assembly of claim 1, wherein the bumper bracket is a "C" bracket and wherein the bumper includes a pair of opposing lateral guide slots extending away from one face towards an opposing face, the terminal legs of the bracket being disposed within the guide slots such that the bumper is clamped within the bracket.

10. The door handle assembly of claim 1, wherein the depressed base extends over a majority of a longitudinal distance of the interior of the bezel, and the depressed base extends completely across a lateral distance of the interior of the bezel.

11. The door handle assembly of claim 1, wherein a first longitudinal end of the latch handle and the second longitudinal end of the latch handle is located within the bezel.

12. The door handle assembly of claim 1, wherein the support bracket extends within an interior compartment established by the bezel, wherein the bezel extends in a direction of a longitudinal extension of the interior compartment less than a majority of the length of the longitudinal extension.

13. The door handle assembly of claim 1, wherein the bezel is configured such that the first mounting boss and the second mounting boss is held in a substantially more rigid manner than the first lateral face and the second lateral face is held by the lock knob.

14. The door handle assembly of claim 1, wherein at least one of the first lateral sidewall or the second lateral sidewall extends from the front of the bezel to the back of the bezel.

15. The door handle assembly of claim 1, wherein the first lateral sidewall and the second lateral sidewall establish the top portion of the bezel.

16. The door handle assembly of claim 1, wherein at least one of the first lateral sidewall or the second lateral sidewall have a thickens at the very top of the bezel that is at least about the same as the thickness of the respective sidewalls at locations at about the mid-way portion of the sidewalls with respect to the top and the bottom of the bezel.

17. The door handle assembly of claim 1, wherein the bumper bracket is an integral bumper bracket.

18. The door handle assembly of claim 1, wherein the bumper bracket is an integral bumper bracket, and the bumper is of trapezoidal confirmation.

19. A door handle assembly comprising:

a bezel of monolithic molded polymer construction, the bezel including a depressed base extending partially but not completely along the length of the bezel with a first lateral sidewall and a second lateral sidewall extending upwardly from opposing sides of the base, the bezel further including an integral end wall intersecting the lateral sidewalls, the end wall being disposed in space-apart forward relation from a forward edge of the base, the bezel further including a molded-in integral support bracket extending longitudinally between the base and the end wall, the support bracket defining a boundary between a first chamber and a second chamber in the space between the base and the end wall, the support bracket including a support bracket mounting flange projecting upwardly away from the plane defined by the base with a first mounting boss projecting away from one side of the support bracket mounting flange and partially across the second chamber, the first lateral sidewall including a boss-receiving wall aperture therein which opens into the first chamber, the second lateral sidewall including a second mounting boss projecting partially across the second chamber in opposing aligned relation to the first mounting boss such that the first mounting boss, the second mounting boss and the wall aperture are substantially concentrically aligned along a common axis running between the first and second lateral sidewalls;

a latch handle having an anchor end including a downwardly extending contoured ear disposed within the first chamber and a downwardly extending boss-receiving flange disposed in substantially parallel spaced-apart relation from the contoured ear to define a handle cavity between the boss-receiving flange and the contoured ear, the contoured ear including a laterally projecting handle boss, wherein the support bracket mounting flange is disposed in nested relation within the handle cavity with the handle boss extending into the boss-receiving wall aperture and the first mounting boss projecting through the boss-receiving flange such that a distal portion of the first mounting boss projects outwardly from the boss-receiving flange towards the second mounting boss; and a lock knob including a body of split construction disposed within the second chamber, the lock knob including a first lateral face and a second lateral face with a void between the first and second lateral faces such that the first and second lateral faces are resiliently compressible towards one another, the first lateral face and the second lateral face each including an aligned aperture such that upon press-fit insertion of the body into the second chamber, the distal portion of the first mounting boss projects into the aperture in the first lateral face and the second mounting boss projects into the aperture in the second lateral face such that the lock knob is supported in rotatable relation about the common axis with the latch handle, wherein the lock knob is configured to resiliently compress such that the first lateral face and the second lateral face fit completely between the first mounting boss and the second mounting boss along a trajectory from respective outer edges of the first and second lateral faces to the respective apertures during insertion of the body into the second chamber, and wherein a bumper bracket is positioned near the bottom of the first chamber to project away from the end wall and into the first chamber with a resilient bumper mounted within the bumper bracket from below the bezel.

20. The door handle assembly of claim 19, wherein each of the bezel, the latch handle and the lock knob is of monolithic, polymer molded construction.

21. The door handle assembly of claim 20, wherein the bezel extends from beyond a first longitudinal end of the latch handle to beyond a second longitudinal end of the latch handle.

22. The door handle assembly of claim 21, wherein the bezel extends from beyond a first lateral side of the latch handle to beyond a lateral side of the latch handle.

23. The door handle assembly of claim 20, wherein the bezel establishes an open interior compartment enveloping at least a substantial portion of the latch handle and at least a substantial portion of the lock knob.

24. The door handle assembly of claim 20, wherein the support bracket extends within an interior compartment established by the bezel, wherein the bezel extends in a direction of a longitudinal extension of the interior compartment less than a majority of the length of the longitudinal extension.

25. The door handle assembly of claim 20, wherein a distance between the first mounting boss and the second mounting boss is the same before, during and after movement along the trajectory.

26. The door handle assembly of claim 20, wherein the bezel establishes an open interior compartment enveloping at least a substantial portion of the entire latch handle and at least a substantial portion of the entire lock knob.

27. The door handle assembly of claim 20, wherein the lock knob is retained within the bezel via an interference fit.

28. The door handle assembly of claim 20, wherein the first mounting boss supports both the lock knob and the latch handle.

29. The door handle assembly of claim 19, further including an interior cover disposed in juxtaposed snap-in relation across the base, and wherein the interior cover in combination with interior portions of the first and second lateral sidewalls cooperatively define a visible show surface for the door handle assembly.

30. The door handle assembly of claim 19, wherein an integral open sided cradle flange extends away from the support bracket and into first chamber and wherein one leg of a biasing spring is supported at the open sided cradle and an opposing leg of the biasing spring operatively engages a surface of latch handle within the first chamber such that rotation of the latch handle causes compression of the biasing spring.

31. The door handle assembly of claim 19, wherein the bumper bracket is a "C" bracket and wherein the bumper includes a pair of opposing lateral guide slots extending away from one face towards an opposing face, the terminal legs of the bracket being disposed within the guide slots such that the bumper is clamped within the bracket.

32. The door handle assembly of claim 19, wherein the bumper bracket is an integral bumper bracket.

33. The door handle assembly of claim 19, wherein the bumper bracket is an integral bumper bracket, and the bumper is of trapezoidal confirmation.

34. A method of assembling a vehicle door handle assembly, comprising the steps of:

providing a bezel including a first lateral sidewall and a second lateral sidewall, an end wall, and an integral support bracket defining a boundary between a first chamber and a second chamber, the support bracket including a first mounting boss projecting away from one side of the support bracket, the first lateral sidewall including a boss-receiving wall aperture therein, the second lateral sidewall including a second mounting boss projecting in opposing aligned relation to the first mounting boss such that the first mounting boss, the second mounting boss and the wall aperture are substantially concentrically aligned along a common axis;

providing a latch handle including an ear and a boss-receiving flange disposed in spaced-apart relation from the ear, the ear including a laterally projecting handle boss, and arranging the latch handle with the support bracket disposed in nested relation between the ear and the boss-receiving flange with the handle boss extending into the boss-receiving wall aperture and the first mounting boss projecting through the boss-receiving flange such that a distal portion of the first mounting boss projects outwardly from the boss-receiving flange towards the second mounting boss; and after the action of arranging the latch handle, providing a lock knob including a resiliently compressible body, the lock knob including a first lateral face and a second lateral face, the first lateral face and the second lateral face each including an aligned aperture and applying press-fit insertion of the body between the support bracket and second lateral sidewall such that the distal portion of the first mounting boss projects into the aperture in the first lateral face and the second mounting boss projects into the aperture in the second lateral face such that the lock knob is supported in rotatable relation about the common axis with the latch handle, wherein the method further comprises providing a bumper bracket positioned near the bottom of the first chamber to project away from the end wall and into the first chamber with a resilient bumper mounted within the bumper bracket from below the bezel.

35. The method as recited in claim 34, including the further steps of providing an integral open sided cradle flange extends away from the support bracket and into first chamber and inserting a biasing spring into the first chamber with two offset legs oriented downwardly such that one leg of the biasing spring is supported on the open sided cradle and an opposing leg of the biasing spring operatively engages a surface of latch handle within the first chamber such that rotation of the latch handle causes compression of the biasing spring.

36. The method as recited in claim 35, wherein the action of providing the bezel further includes providing a bezel including a depressed base extending partially but not completely along the length of the bezel, wherein the end wall is disposed in space-apart forward relation from a forward edge of the base, and the integral support bracket extends between the base and the end wall to define a boundary between a first chamber and a second chamber in the space between the base and the end wall.

37. The method as recited in claim 34, wherein each of the latch handle, the lock knob, the biasing spring and the resilient bumper are mounted within the bezel entirely by linear movements.

38. The method as recited in claim 17, wherein action of providing the latch handle entails providing the latch over the first mounting boss with the latch in an undeformed state.

39. The method as recited in claim 17, wherein the first mounting boss supports both the lock knob and the latch handle.

40. The method as recited in claim 34, wherein the bumper bracket is an integral bumper bracket.

41. The method as recited in claim 34, wherein the bumper bracket is an integral bumper bracket, and the bumper is of trapezoidal confirmation.

* * * * *